US007254972B1

(12) United States Patent
Wang

(10) Patent No.: US 7,254,972 B1
(45) Date of Patent: Aug. 14, 2007

(54) MOVING MOLD MECHANISM OF A PIPE BENDING MACHINE

(75) Inventor: Sheng-Tsung Wang, Yung Kang (TW)

(73) Assignee: Chia Sheng Machinery Co., Ltd., Tainan County (TW)

( * ) Notice: Subject to any disclaimer, the term of this patent is extended or adjusted under 35 U.S.C. 154(b) by 0 days.

(21) Appl. No.: 11/476,169

(22) Filed: Jun. 28, 2006

(51) Int. Cl.
*B21D 7/04* (2006.01)

(52) U.S. Cl. ..... 72/157; 72/149; 72/155

(58) Field of Classification Search ..... 72/149, 72/154, 155, 156, 157, 158, 159, 306, 307
See application file for complete search history.

(56) References Cited

U.S. PATENT DOCUMENTS 4,843,859 A * 7/1989 Togoshi ..... 72/149
4,888,971 A * 12/1989 Schwarze ..... 72/157
5,263,350 A * 11/1993 Crippa ..... 72/157
5,499,522 A * 3/1996 Schwarze ..... 72/157
5,689,988 A * 11/1997 Schwarze ..... 72/157
6,038,903 A * 3/2000 Traub ..... 72/149
6,434,993 B1 * 8/2002 Broggi et al. ..... 72/157
6,694,794 B2 * 2/2004 Crippa ..... 72/307
6,854,311 B2 * 2/2005 Schmauder et al. ..... 72/157
7,021,102 B2 * 4/2006 Schmauder ..... 72/149
2004/0200253 A1 * 10/2004 Schmauder et al. ..... 72/149

* cited by examiner

*Primary Examiner*—Dmitry Suhol
(74) *Attorney, Agent, or Firm*—Rosenberg, Klein & Lee

(57) ABSTRACT

A pipe bending machine has a moving mold mechanism, which includes two mold seats positioned one above other, and pressing wheels on each mold seat to work with corresponding bending wheels of fixed molds of the machine; the mold seats are moved by means of a rotating power source whose motion is transmitted by means of a roller, which has spiral grooves; each mold seat has a sliding element secured thereto, and a guide post slidable on the sliding element and passing into a corresponding spiral grooves; guiding mechanisms are interposed between the mold seats and the fixed molds for allowing the mold seats to move up and down along a sloping path; when the rotating power source rotates the roller, both the mold seats will move forwards and backwards in crossing directions respectively as well as upwards and downwards in a sloping path respectively.

3 Claims, 9 Drawing Sheets

MOVING MOLD MECHANISM OF A PIPE BENDING MACHINE

BACKGROUND OF THE INVENTION

1. Field of the Invention

The present invention relates to a moving mold mechanism of a pipe bending machine, more particularly one, which includes two fixed molds, bending wheels on each fixed mold, two moving mold seats facing respective fixed molds, several pressing wheels on each moving mold seat, rotating power source, a roller having spiral grooves and connected to the rotating power source for transmitting motion to the moving mold seats, and guiding mechanisms and linear rail mechanisms for making both the moving mold seats moved forwards and backwards in crossing directions respectively as well as upwards and downwards in a sloping path respectively so as to carry out a pipe bending process and to end a pipe bending process.

2. Brief Description of the Prior Art

An early pipe bending machine includes a pipe feeding mechanism, a fixed mold, a bending wheel secured on the fixed mold, and a moving mold mechanism, which consists of a mold seat member, and a pressing wheel on the mold seat member. In use, a pipe is fed between the bending wheel of the fixed mold and the pressing wheel of the moving mold mechanism by means of the pipe feeding mechanism, the mold seat member is moved about the bending wheel by means of a power source for the pressing wheel to bend the pipe into a certain curve together with the bending wheel. The user has to replace the current bending wheel and pressing wheel with different-sized ones every time before a pipe is bent into a curve with a radius different from that of the last pipe. Therefore, such pipe bending machine isn't convenient to use.

To overcome such inconvenience, an improvement on a pipe bending machine is equipped with a fixed mold, several different-sized upper bending wheels and several lower bending wheels on the fixed mold, upper and lower moving mold seat members, and two power source mechanisms for moving respective ones of the moving mold seat members; each moving mold seat member has several different-sized pressing wheels positioned thereon. The upper pressing wheels face and work with corresponding upper bending wheels of the fixed mold for bending pipes into curves with different radiuses while the lower pressing wheels face and work with corresponding lower bending wheels for bending pipes into curves with different radiuses. Therefore, the use doesn't have to replace the bending wheels and the pressing wheels with different-sized ones.

However, because the pipe bending machine is equipped with two power source mechanisms for moving the upper and the lower moving mold seat members respectively, its manufacturing cost is relatively high. Furthermore, because the power source mechanisms are positioned parallel to the moving mold seat members, the moving mold seat members are prone to be interfered with when they are moving away from the bending wheels at the end of a pipe bending process.

SUMMARY OF THE INVENTION

It is a main object of the invention to provide an improvement on moving mold mechanism of a pipe bending machine, which will result in reduction in manufacturing cost, and prevent interference with a pipe bending process.

The moving mold mechanism of the present invention includes two mold seat members positioned one above other, and several pressing wheels on each mold seat member to work with corresponding bending wheels of upper and lower fixed molds of the pipe bending machine. The mold seats are moved by means of a rotating power source whose motion is transmitted to the mold seat members by means of a roller, which has spiral grooves thereon. Each of the mold seat members has a sliding element secured thereto, and a guide post slidable on the sliding element and passing into a respective one of the spiral grooves of the roller.

A linear rail mechanism is interposed between each one of the sliding elements of the mold seat members and a corresponding guide post. And, guiding mechanisms are interposed between the mold seat members and the fixed molds for allowing the mold seat members to move up and down along a sloping path. Thus, when the rotating power source is actuated to cause rotation of the roller, the roller will cause motion of the mold seat members through the guide posts secured on the mold seat members and received in the spiral grooves of the roller, and both the mold seat members will move forwards and backwards in crossing directions respectively as well as upwards and downwards in a sloping path respectively, to carry out a pipe bending process and to end a pipe bending process, owing to the linear rail devices and the guiding mechanisms.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
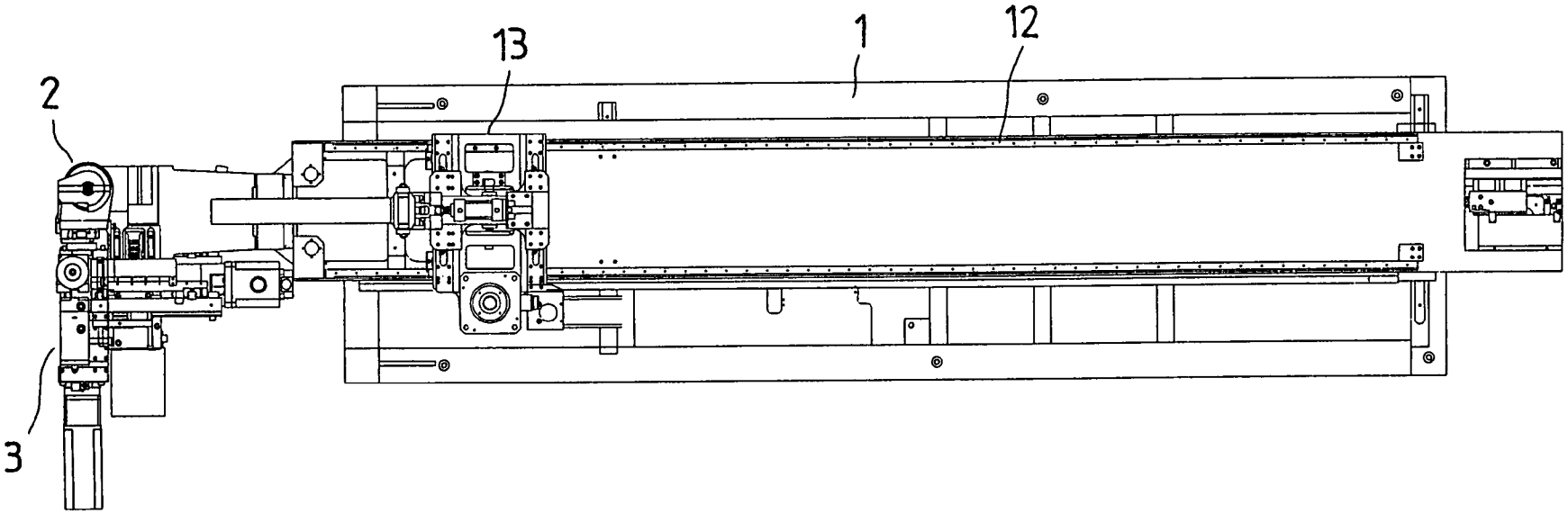
FIG. 1 is a top view of the pipe bending machine in the present invention.
Figure 2:
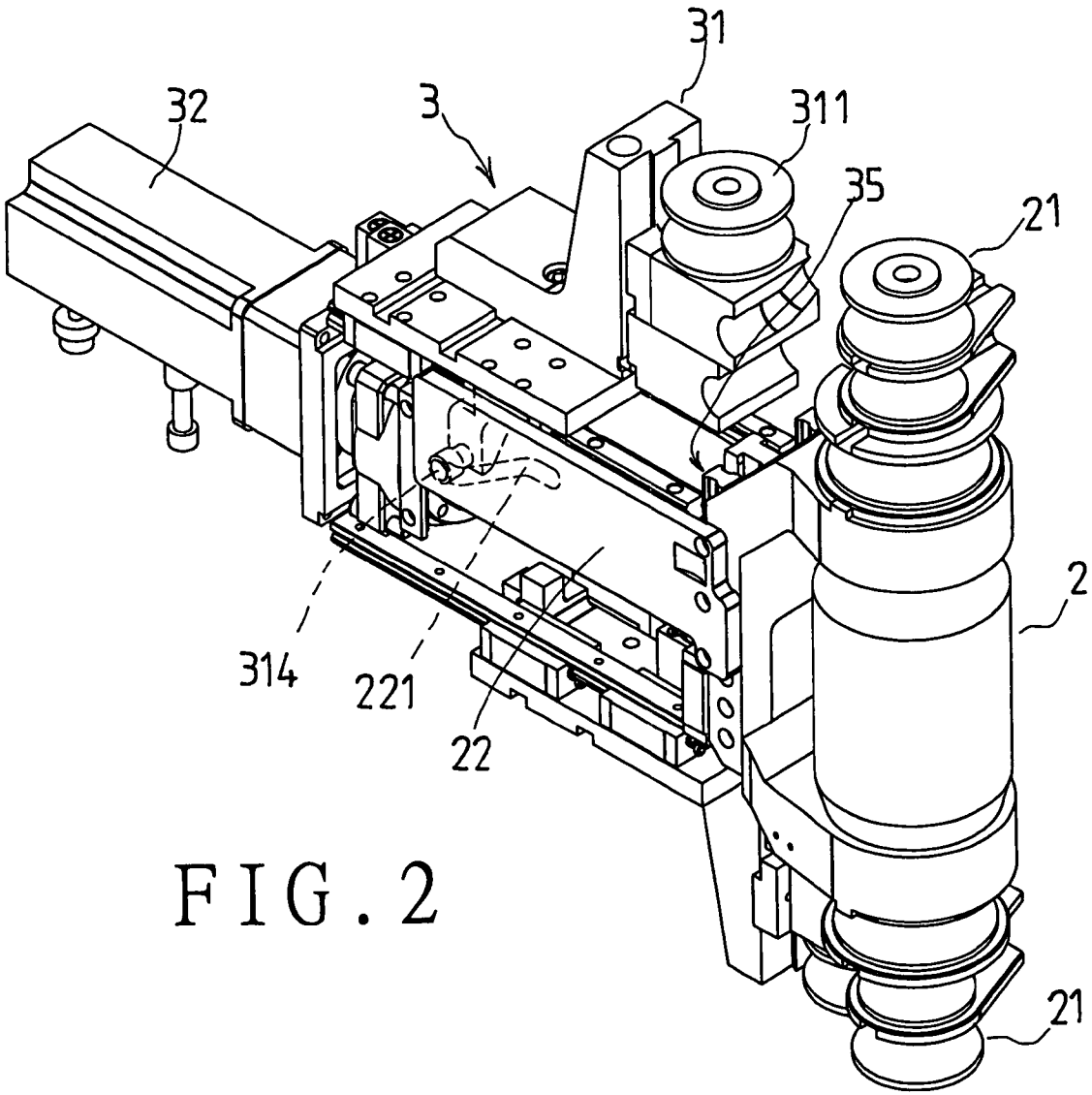
FIG. 2 is a partial perspective view of the first embodiment.
Figure 3:
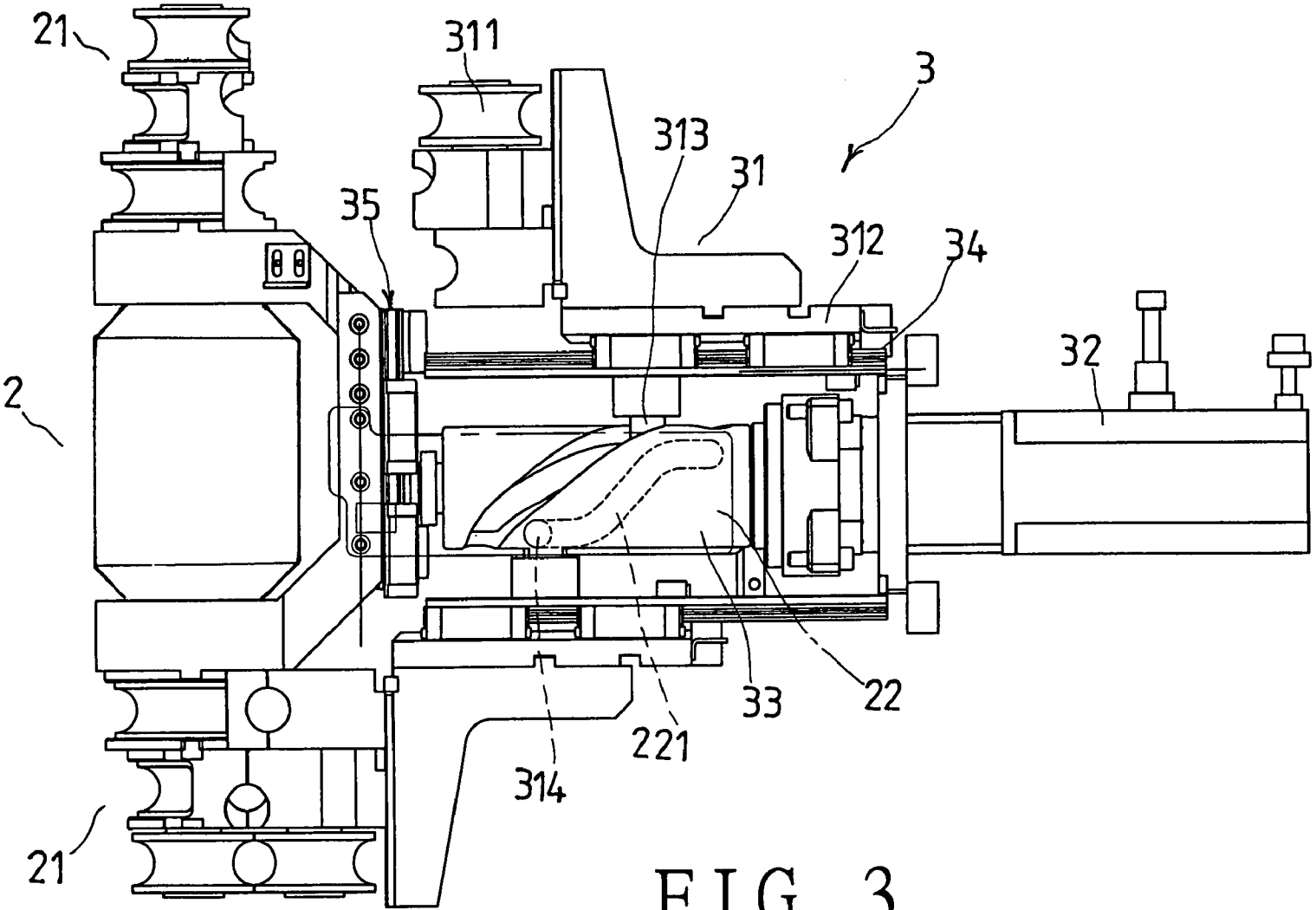
FIG. 3 is a partial side view of the first preferred embodiment.
Figure 4:
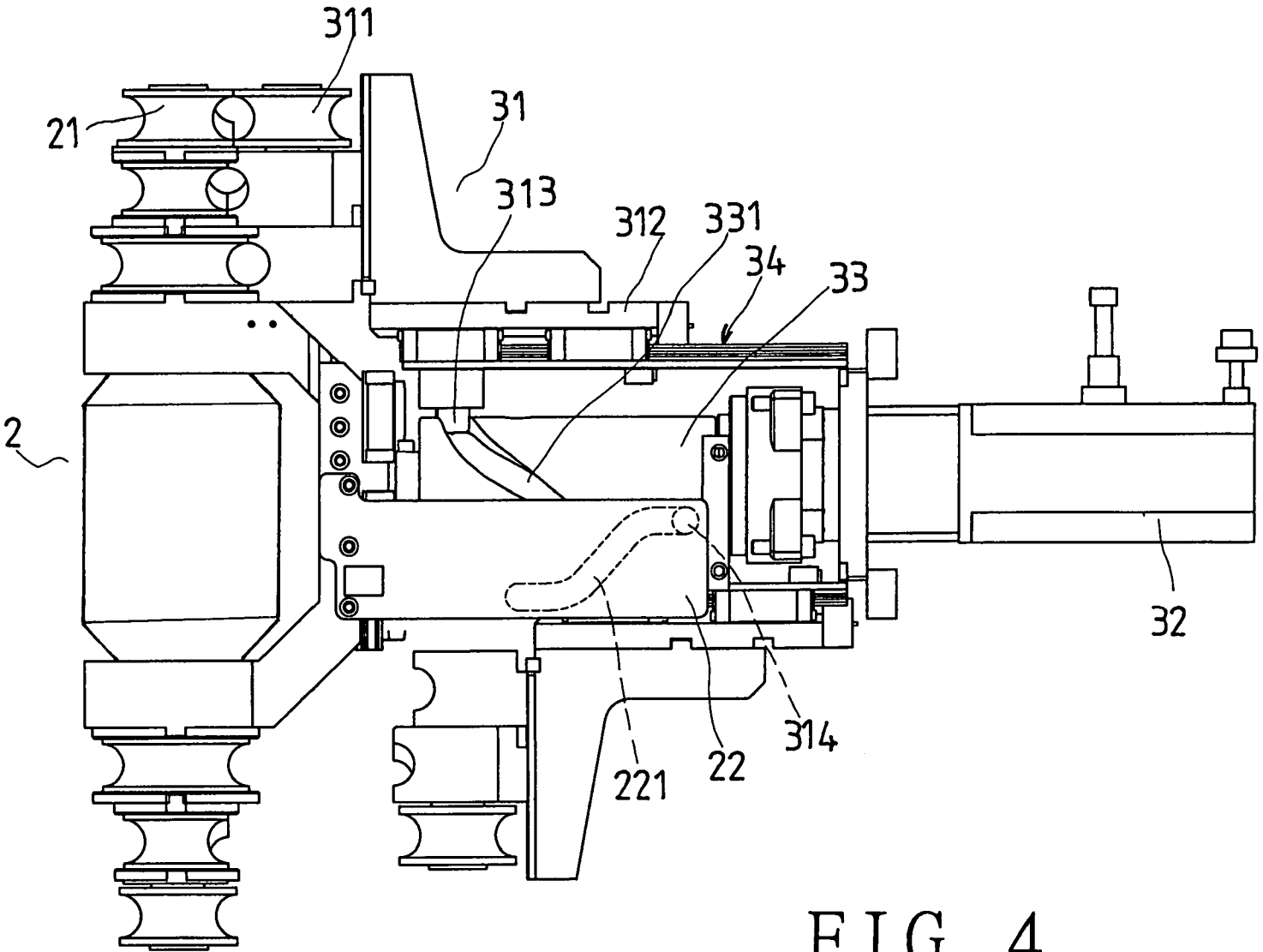
FIG. 4 is a partial side view of the first preferred embodiment, taken when the mold mechanism is working to bend a pipe.

Referring to FIGS. 1 to 3, a pipe bending machine in the present invention includes a bed 1, two fixed molds 2, and a moving mold mechanism 3.

The fixed molds 2 are fitted to the bed 1 one above the other. Each of the fixed molds 2 has several different-sized bending wheels 21 thereon. The moving mold mechanism 3 is connected to an arm member (not numbered), which is moved about the bending wheels 21 by means of a power source. The moving mold mechanism 3 has two mold seat members 31 one above the other, each of which has several different-sized pressing wheels 311 thereon facing and working with the different-sized bending wheels 21 of the fixed molds 2. The mold seat members 31 are moved by means of a rotating power source whose motion is transmitted to the mold seat members 31 by means of a roller 33 and linear rail mechanisms 34 and 35; thus, the mold seat members 31 can be moved forwards and backwards. Furthermore, a guiding mechanism is interposed between the mold seat members 31 and the fixed molds 2 for allowing the mold seat members 31 to move up and down along a sloping path. The bed 1 has several rails 12 fitted thereon, and a pipe feeding mechanism 13 is slidable along the rails 12 for feeding pipes between the bending wheels 21 and the pressing wheels 311.

Figure 5:
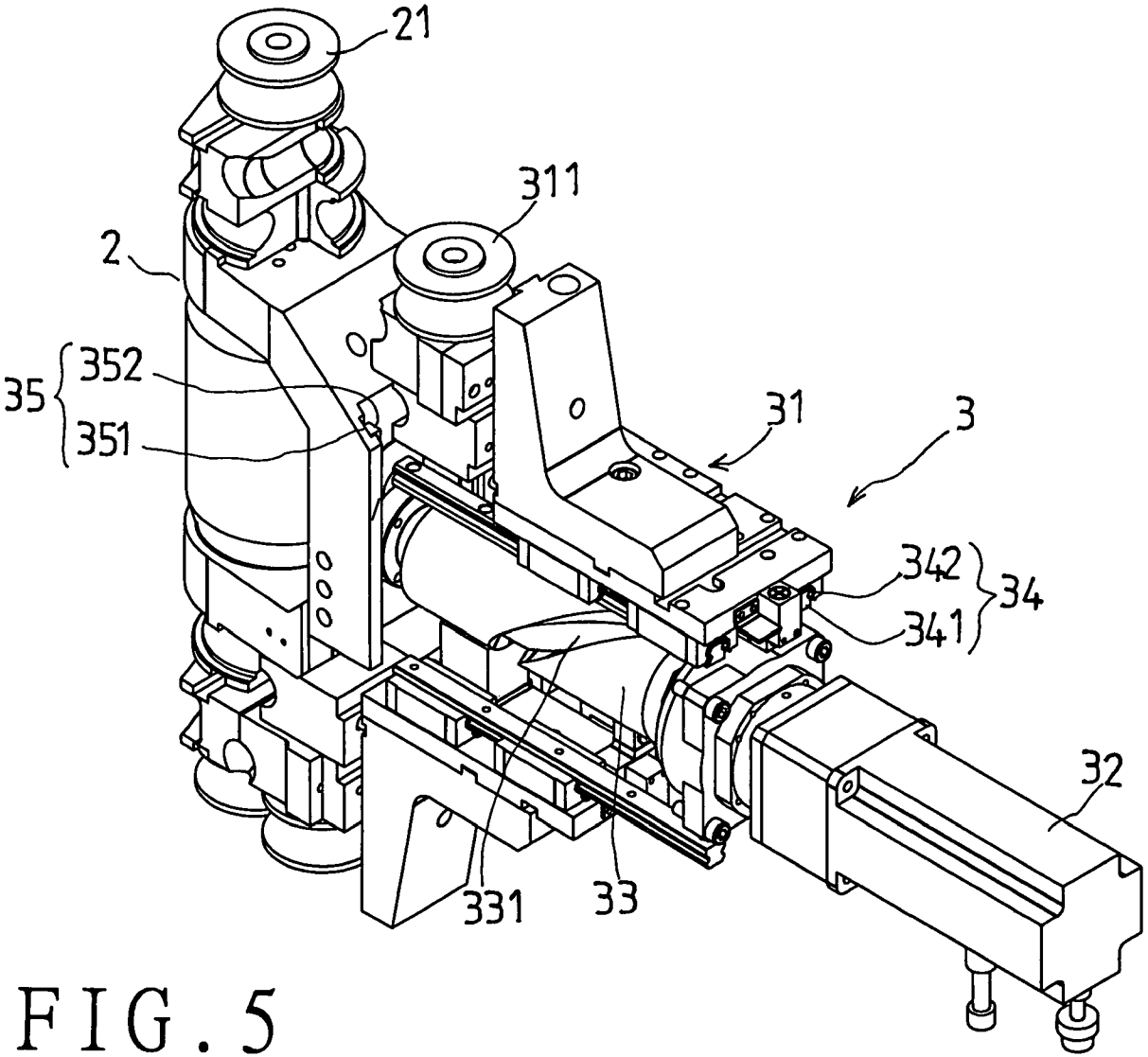
FIG. 5 is a partial perspective view of the second embodiment.
Figure 6:
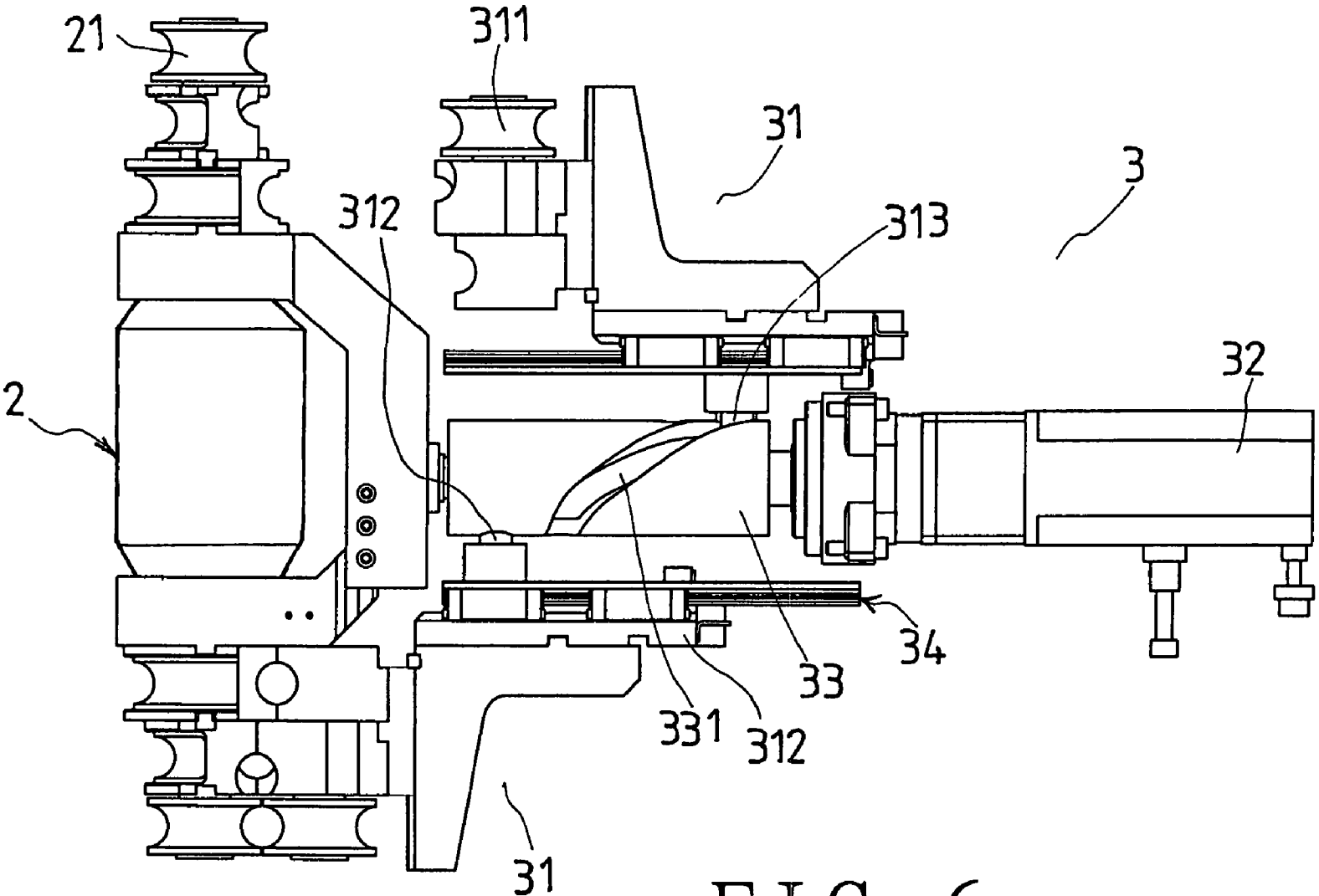
FIG. 6 is a partial side view of the second preferred embodiment.
Figure 9:
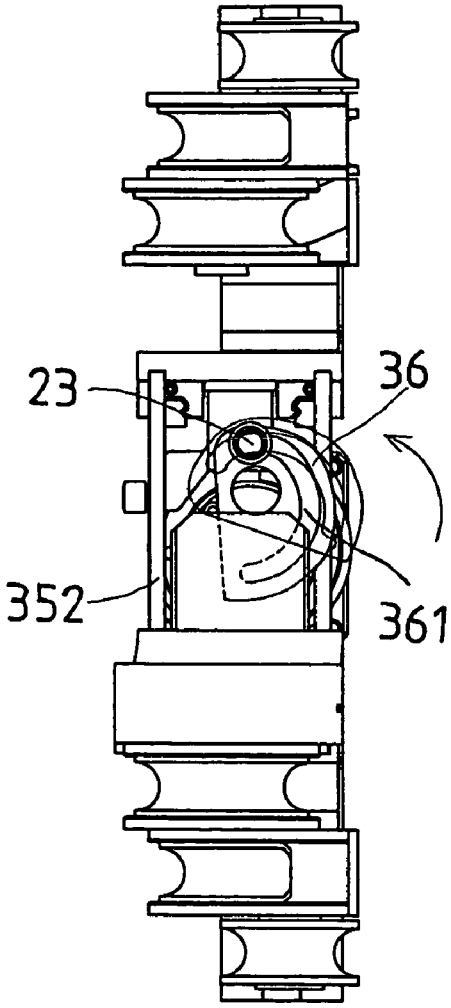
FIG. 9 is a partial front view of the second preferred embodiment, taken when the mold mechanism is working to bend a pipe.
Figure 7:
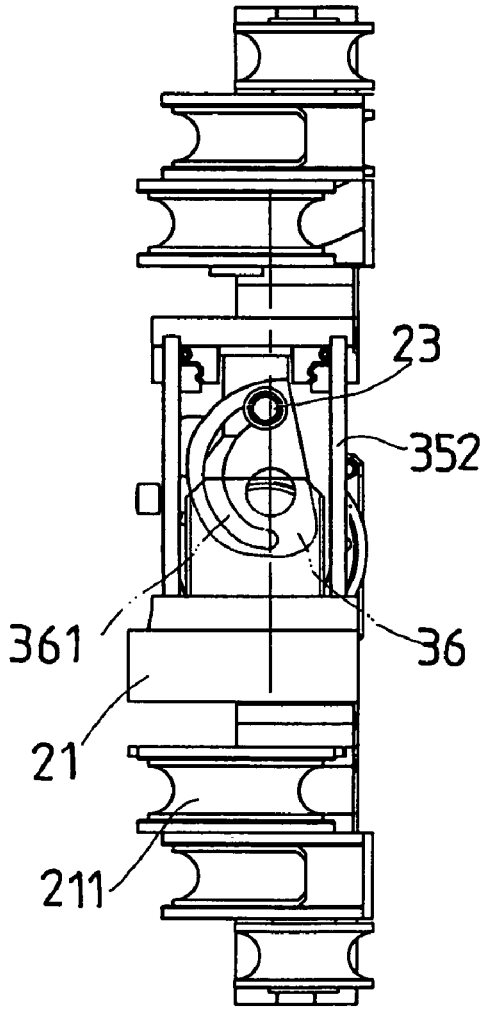
FIG. 7 is a partial front view of the second preferred embodiment.
Figure 8:
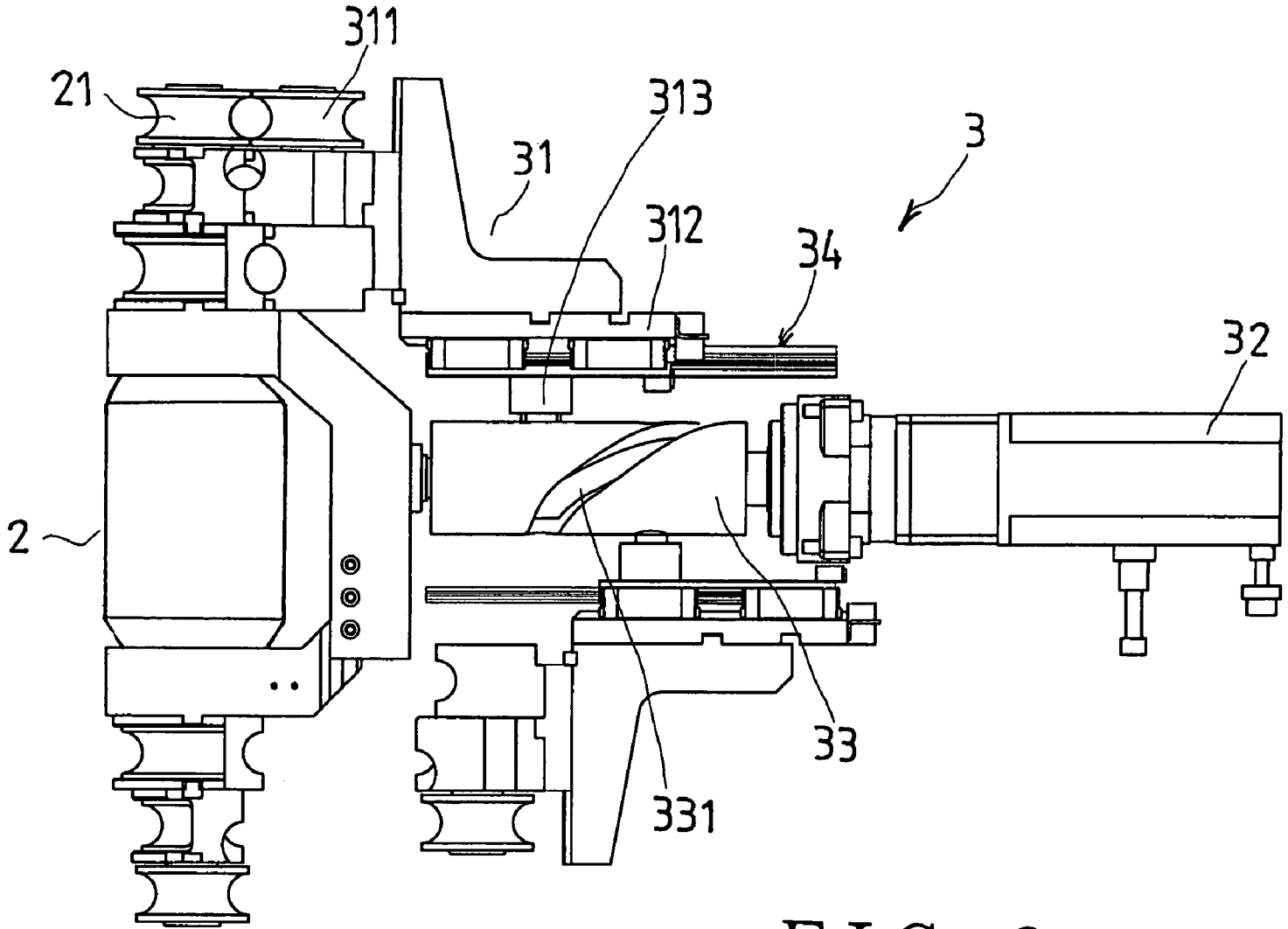
FIG. 8 is a partial side view of the second preferred embodiment, taken when the mold mechanism is working to bend a pipe.
Figure 10:
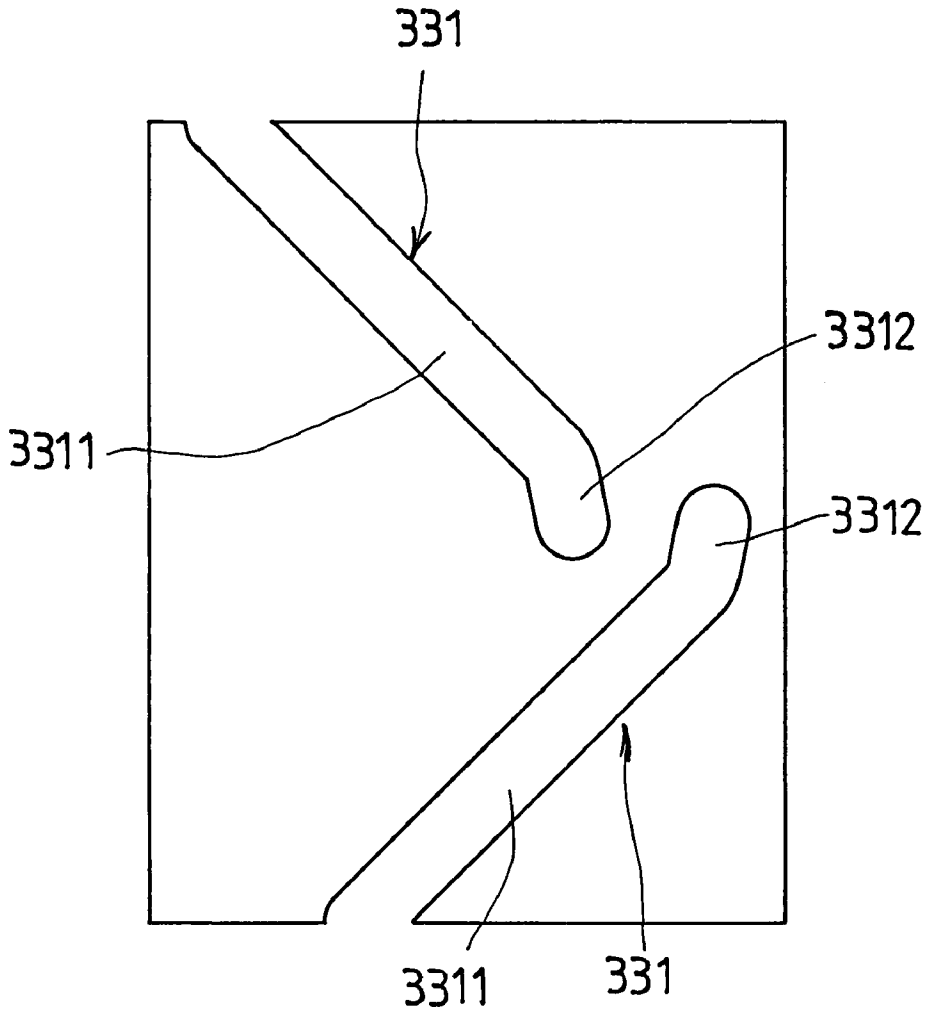
FIG. 10 is a spread-out view of the roller in the present invention.

FIGS. 2, 3, 4, and 10 show a first preferred embodiment of the present invention. The roller 33 has spiral grooves 331 on two sides of an outer circumferential portion thereof, each of which spiral grooves 331 is divided into a front section 3311, and a rear section 3312 having a smaller slope than the front section 3311. Each of the mold seat members 31 has a sliding element 312 secured thereto; each of the sliding elements 312 has a guide post 313 slidable thereon and pointing to the roller 33. The guide posts 313 are in two crossing directions, and pass into respective ones of the spiral grooves 331 of the roller 33. The guiding mechanism includes lateral planks 22, and guide bars 314; the lateral planks 22 are secured to respective ones of the fixed molds 2, and each have a sloping guide groove 221 on an inner side thereof; the guide bars 314 project from respective ones of the sliding elements 312, and are passed into respective ones of the sloping guide grooves 221; thus, the mold seat members 31 will be guided up and down along a sloping path. The linear rail mechanisms 34 are interposed in a horizontal position between the sliding elements 312 and the guide posts 313. The linear rail mechanisms 35 are interposed in a vertical position between the mold mechanisms 3 and the fixed molds 2, as shown in FIG. 5. Each of the linear rail mechanisms 34 includes a rail 341 fitted on the guide post 313, and a groove 342 formed on the sliding element 312; the rail 341 is passed into the groove 342. Each of the linear rail mechanisms 35 includes a rail 352 fitted on the moving mold mechanism 3, and a groove 351 on the fixed mold 2; the rail 352 is passed into the groove 351.

When the rotating power source 32 is actuated, the rotating power source 32 will cause rotation of the roller 33, and the roller 33 will cause motion of the guide posts 313, which are currently received in the front sections 3311 of the spiral grooves 331 of the roller 33; thus, the mold seat members 31 move forwards rapidly during the first part of their motion. Next, the guide posts 313 will move into the less sloping rear sections 3312 of the spiral grooves 331 during the last part of the motion of the mold seat members 31; thus, the mold seat members 31 will be made to have a greater torque output, and guided forwards by means of the linear rail mechanisms 34 to bend a pipe. Because the guide posts 313 of both the mold seat members 31 are in crossing directions, and pass into the spiral grooves 331 of the roller 33, both the mold seat members 3 will move in crossing directions towards the fixed molds 2 to press the pipes and get away from the fixed molds 2 respectively when the power source 32 rotates the roller 33. At the same time, the mold seat members 31 will move towards/away from the fixed molds 2 along a sloping path owing to the guide bars 314, the sloping guide grooves 221 of the lateral planks 22, and the linear rail mechanisms 35 interposed between the moving mold mechanism 3 and the fixed molds 2. In other words, when the rotating power source 32 is actuated, the roller 33 will cause motion of the mold seat members 31 through the guide posts 313 secured on the mold seat members 31 and received in the spiral grooves 331 of the roller 33, and both the mold seat members 31 will move forwards and backwards in crossing directions respectively as well as upwards and downwards in a sloping path respectively, to carry out a pipe bending process and to end a pipe bending process, owing to the linear rail mechanisms 34, 35 and the guiding mechanisms.

Referring to FIGS. 5 to 10, a second preferred embodiment of the present invention includes a bed 1, two fixed molds 2, and a moving mold mechanism 3 including two mold seat members 31 one above the other.

The mold seat members 31 are moved by means of a rotating power source whose motion is transmitted to the mold seat members 31 by means of a roller 33 and linear rail mechanisms 34 and 35. Furthermore, a guiding mechanism is interposed between the mold seat members 31 and the fixed molds 2 for allowing the mold seat members 31 to move up and down along a sloping path. The roller 33 has spiral grooves 331 on two sides of an outer circumferential portion thereof, each of which spiral grooves 331 is divided into a front section 3311, and a rear section 3312 having a smaller slope than the front section 3311. Each of the mold seat members 31 has a sliding element 312 secured thereto; each of the sliding elements 312 has a guide post 313 slidable thereon and pointing to the roller 33. The guide posts 313 pass into respective ones of the spiral grooves 331 of the roller 33. The guiding mechanism includes an eccentric cam 36, and guide bars 22; the eccentric cam 36 is joined to a front force output portion of the roller 33, and has a curved guide slot 361 thereon; the guide bars 314 securely joined to the fixed molds 2, and are passed into the curved guide slots 361 of the eccentric cams 36; thus, the mold seat members 31 will be guided up and down along a sloping path. The linear rail mechanisms 34 are interposed in a horizontal position between the sliding elements 312 and the guide posts 313. The linear rail mechanisms 35 are interposed in a vertical position between the moving mold mechanism 3 and the fixed molds 2. Each of the linear rail mechanisms 34 includes a rail 341 fitted on the guide post 313, and a groove 342 formed on the sliding element 312; the rail 341 is passed into the groove 342. Each of the linear rail mechanisms 35 includes a rail 352 fitted on the moving mold mechanism 3, and a groove 351 on the fixed mold 2; the rail 352 is passed into the groove 351.

When the rotating power source 32 is actuated, the rotating power source 32 will cause rotation of the roller 33, and the roller 33 will cause motion of the guide posts 313, which are currently received in the front sections 3311 of the spiral grooves 331 of the roller 33; thus, the mold seat members 31 move forwards rapidly during the first part of their motion. Next, the guide posts 313 will move into the less sloping rear sections 3312 of the spiral grooves 331 during the last part of the motion of the mold seat members 31; thus, the mold seat members 31 will be made to have a greater torque output, and guided forwards by means of the linear rail devices 34 to bend a pipe. Because the guide posts 313 of both the mold seat members 31 are in crossing directions, and pass into the spiral grooves 331 of the roller 33, both the mold seat members 31 will move in crossing directions to press and get away from the pipe respectively when the power source 32 rotates the roller 33. At the same time, the mold seat members 31 will move towards/away from the fixed molds 2 along a sloping path owing to the eccentric cams 36 joined to the force output portion of the roller 33, and the guide bars 221, which are secured to the fixed molds 2 as well as passed into the curved guide slots 361 of the eccentric cams 36.

From the above description, it can be seen that the present invention has the following advantages:

1. There is single rotating power source used for moving both the mold seat members of the moving mold mechanism towards/away from the bending wheels of the fixed molds therefore the present invention helps reduce the manufacturing cost.

2. The mold seat members of the moving mold mechanism are moved towards/away from the fixed molds along a sloping path therefore the mold seat members will be at a different height from the fixed molds when moving away from the fixed molds after a pipe bending process. Consequently, interference can't happen.

3. The spiral grooves of the roller each include a front section, and a rear section less sloping than the front section. Therefore, the mold seat members of the moving mold mechanism will move more rapidly during the first part of their motion, and have a greater torque output to bend a pipe during the last part of their motion.

What is claimed is:

1. A moving mold mechanism of a pipe bending machine, comprising a bed, two fixed molds positioned one above other on the bed, each of the fixed molds having a plurality of bending wheels thereon; and a moving mold mechanism connected to an arm member, which is moved to swing by means of a power source, the moving mold mechanism including two mold seat members positioned one above other, each of the mold seat members having a plurality of pressing wheels thereon;

the mold seat members being moved by means of a rotating power source whose motion is transmitted to the mold seat members by means of a roller joined to an force output portion of the rotating power source; the roller having spiral grooves thereon; each of the spiral grooves being divided into a front section, and a rear section having a smaller slope than the front section; each of the mold seat members having a sliding element secured thereto, and a guide post slidable on the sliding element and passing into a respective one of the spiral grooves of the roller;

a first linear rail mechanism interposed between each one of the sliding elements of the mold seat members and a corresponding guide post; and guiding mechanisms interposed between the mold seat members and the fixed molds for allowing the mold seat members to move up and down along a sloping path;

whereby when the rotating power source is actuated to cause rotation of the roller, the roller will cause motion of the mold seat members through the guide posts secured on the mold seat members and received in the spiral grooves of the roller, and both the mold seat members will move forwards and backwards in crossing directions respectively as well as upwards and downwards in a sloping path respectively, to carry out a pipe bending process and to end a pipe bending process, owing to the linear rail mechanisms and the guiding mechanisms.

2. The moving mold mechanism of a pipe bending machine as recited in claim 1, wherein each of the guiding mechanisms includes a guide bar on a lateral side of a corresponding mold seat member, and a guide groove formed on a lateral side of a corresponding fixed mold, in which the guide bar is received, and second linear rail mechanisms are interposed between the fixed molds and the mold seat members; thus, when the rotating power source is actuated, both the mold seat members will move upwards to carry out a pipe bending process and downwards to end a pipe bending process respectively owing to the guide bars, the guide grooves, and the linear rail mechanisms.

3. The moving mold mechanism of a pipe bending machine as recited in claim 1, wherein each of the guiding mechanisms includes an eccentric cam joined to a front force output portion of the roller, and a guide bar securely joined to a corresponding fixed mold; the eccentric cam having a curved guide slot thereon, in which the guide bar is received; second linear rail mechanisms being interposed between the fixed molds and the mold seat members; thus, when the rotating power source is actuated, both the mold seat members will move upwards to carry out a pipe bending process and downwards to end a pipe bending process respectively owing to the eccentric cams, the curved guide slots, and the linear rail mechanisms.

* * * * *